US005335871A

United States Patent [19]

Fissmann et al.

[11] Patent Number: 5,335,871

[45] Date of Patent: Aug. 9, 1994

[54] WINDER FOR REWINDING A WEB, ESPECIALLY A PAPER WEB

[75] Inventors: Hans-Joachim Fissmann; Hans Weiss, both of Heidenheim, Fed. Rep. of Germany

[73] Assignee: J. M. Voith GmbH, Heidenheim, Fed. Rep. of Germany

[21] Appl. No.: 37,296

[22] Filed: Mar. 26, 1993

[30] Foreign Application Priority Data

Mar. 26, 1992 [DE] Fed. Rep. of Germany ..... 4209754

[51] Int. Cl.[5] ..... B65H 18/20

[52] U.S. Cl. ..... 242/595.1; 242/542; 242/542.4

[58] Field of Search ..... 242/66, 65

[56] References Cited

U.S. PATENT DOCUMENTS

| | | | |
|---|---|---|---|
| 2,461,387 | 2/1949 | Medbery | 242/66 |
| 3,606,186 | 9/1971 | Cohn et al. | 242/66 |
| 4,344,585 | 8/1982 | Eglinton | 242/66 |
| 4,465,243 | 8/1984 | Welp | 242/66 |
| 4,893,762 | 1/1990 | Kuhn | 242/65 X |

FOREIGN PATENT DOCUMENTS

| | | |
|---|---|---|
| 0157062 | 10/1985 | European Pat. Off. . |
| 678585 | 8/1939 | Fed. Rep. of Germany . |
| 2757247 | 7/1978 | Fed. Rep. of Germany . |
| 7310606 | 10/1980 | Fed. Rep. of Germany . |
| 3121039 | 12/1982 | Fed. Rep. of Germany . |
| 3839244 | 9/1989 | Fed. Rep. of Germany . |

*Primary Examiner*—John M. Jillions

*Attorney, Agent, or Firm*—Ohlandt, Greeley & Ruggiero

[57] ABSTRACT

A winder for winding a running paper web is provided that includes a first and a second support roller that together form a winding bed to hold a paper roll with the paper web wound around the first support roller. The winding bed consists of the first and the second support rollers. The first and the second support rollers are fixed into position with the second support roller being positioned lower than the first support roller so that a plane through the axes of the first and the second support rollers forms an angle with a horizontal plane. The first and the second support rollers each having a liner. The liner of the second support roller is considerably more deformable than the liner of the first support roller.

12 Claims, 4 Drawing Sheets

WINDER FOR REWINDING A WEB, ESPECIALLY A PAPER WEB

BACKGROUND OF INVENTION

The present invention relates to a winder for winding a running paper web. The winder includes two support rollers that together form a winding bed to hold a paper roll with the paper web wound around the first of the two support rollers during operation. The second support rollers is lower than the first support roller so that a plane through the axes of the two support rollers forms an angle with the horizontal.

In the winding of webs, the hardness of winding plays a role in subsequent processing. It Is very critical especially for paper webs for the hardness of the to have a definite progression over the whole diameter of the roll. In general, the hardness of the should drop from a definite initial value to a final value, The decrease should be as uniform as possible from the first layer to the last. It should have a definite gradient, i.e., it should not be too strong and not too weak. The curve of rolling hardness should not in any case show discontinuities, for example a sudden decrease.

This is achieved only when certain measures are taken. If nothing is done, the linear pressure between the roll and the support roller or rollers will become greater and greater with increasing roll diameter, and thus also the hardness of winding.

To avoid this, for example, so-called rider rollers are used that are placed with axis parallel to the support rollers. These rider rollers exert pressure on the roll. The surface pressure is controlled, and is high at the beginning and becomes smaller with increasing roll weight.

The rider roller provides control over the linear pressure and thus the hardness of winding, in the desired direction. However, if it is desired to produce a roll of very large diameter then the linear pressure is also very high in the final phase of rewinding. In the same way, the winding tension increases so that the web may tear or wrinkle.

Other steps for controlling the hardness of winding consist of distributing the load of the roll to the individual support rollers. Support rollers of the same diameter have been positioned at different horizontal levels for this purpose, or support rollers of different diameters are used. It is also known that a harder winding is obtained when winding on a support roller of smaller diameter than when winding on a support roller of larger diameter.

A winder was disclosed by DE-DM 7 310 606 that has two support rollers of equal size. One of these support rollers can be lowered during the winding process from an upper position above the horizontal plane of the axis of the other support roller at the beginning of the winding process. This lowering is intended to produce a core wound firmly from the beginning.

U.S. Pat. No. 2,461,387 describes a winder that has two driven support rollers of different diameters. The support roller with the smaller diameter has a liner with higher friction factor and is driven at a higher speed than the other support roller. This exerts a tensile stress on the outer layer of the web.

DE-OS 27 57 247 relates to a winder with support rollers of equal diameters. The hardness of winding is controlled by changing the distance between the support rollers.

DE-PS 678 585 describes a winder with two support rollers, of which the first has a hard shell and the second a soft one. The axes of the two rollers are in one and the same horizontal plane.

DE 38 39 244 describes a winder with three support rollers. The first support roller is stationary, with the two subsequent support rollers being changeable in position, and having a supporting belt wound around them. It is intended that the hardness of winding over the roll diameter can be controlled by the supporting belt and by changing the positions of the second and third support rollers. The supporting belt is to produce the greatest possible supporting surface to lower the load per unit area. This winder is extraordinarily expensive. It also has a particularly serious drawback. When the paper roll has grown so that it is supported primarily by the supporting belt, the supporting belt may vibrate vigorously so that the paper roll begins to "dance" and can be catapulted out of its bed in this way.

It has also already been suggested in a winder with two support rollers that the shells of these two rollers be made of rubber. The support rollers had the same diameters in this case, and the rubber liner had the same hardness. However, this also leads to vibration and floating of the paper rolls.

EP 0 157 062 B1 describes a winder with two support rollers and one rider roller. The shell surfaces of all of these rollers consist of a number of individual fluid chambers that are located axially side by side, and whose individual shell surfaces constitute the entire shell surface of the roller in question with formation of a butt joint. The supporting behavior of such a roller is naturally nonuniform viewed over the width of the web because of the number of butt joints.

This invention proceeds from DE 31 21 039 C3, in which there are two support rollers arranged so that at least during a certain operating phase the central axis of one support roller lies below the central axis of the other support roller. In this prior publication it remains unanswered which of the two support rollers, i.e., the one around which the paper web is wound, or the one around which it is not wound, is the lower one.

The purpose of this invention is to design a winder for winding a running paper web in such a way that paper rolls can be produced with it that have an even larger diameter compared to known winders, so that the surface pressure (i.e., the maximum surface pressure on the support rollers) is limited as much as possible so that the hardness of winding does not rise disproportionately. In addition, no splits, cracks, or folds occur during the winding, and also so that the cost of construction is kept within reasonable limits, and finally so that there is reliable guidance of the paper roll during the entire operation so that no vibration or "dancing" of the wound roll occurs.

This problem is solved by the features of the winding bed consisting of the first and the second support rollers, with the first and the second support rollers being fixed into position and the second support roller being positioned lower than the first support roller so that a plane through the axes of the first and the second support rollers forms an angle with a horizontal plane. The first and the second support rollers each have a liner, with the liner of the second support roller being considerably more deformable than the liner of the first support roller.

The inventors have chosen the correct combination from a number of known or theoretically conceivable combinations of features. The two features that the second support roller in the running direction of the web (around which the paper web is not wound) is lowered relative to the first, and that just this roller has a relatively flexible roller liner that has the characteristics of a "wide-nip" roller.

This feature of greater softness or compliance can be implemented in various ways in practice. Examples of embodiment are familiar to one skilled in the art. Thus, for example, an elastic roller liner can be chosen, or the roller can be designed as a so-called floating roller that has a rigid yoke, a relatively thin roller liner, and a number of support elements that are provided between the yoke and the liner, or the roller can be made as a tube roller, provided that support by the support rollers is continuoüs all along the roller width, in contrast to EP 0 157 062 B1.-

The invention can also be applied to winders with so-called alternating rewind. A machine-width paper web in this case is divided into a number of narrow strips and is rolled up alternately left and right on a vertical plane. The weight of the paper rolls can be relieved by clamping heads that grip the ends of the particular cores on which the individual paper rolls are rewound. There are limits to such relief, however, since the cores are destroyed beyond a certain weight.

The invention provides the following capabilities:

There is a need to begin with weight relief by means of clamping heads only for larger roll diameters;

or it is necessary to apply only smaller relief forces;

or paper rolls with larger diameters can be made with equal relief up to the limit of core strength;

or simpler and thus cheaper winding cores can be used.

There are two basic versions with the mentioned alternate rewind: The first version uses three support rollers, namely a central roller and two satellite rollers to the left and right. The second version provides for only a single supporting roller.

The invention can also be applied to the first version. Specifically, the individual winding bed is composed exclusively of two support rollers.

It should be avoided that the two support rollers have the same diameters, and at the same time have the same rubber hardness. The two support rollers can thus definitely have some elasticity in their liners. However, the extent of elasticity should be different.

BRIEF DESCRIPTION OF THE DRAWINGS

The invention and the state of the art are explained in detail in the drawing. In detail, the drawing shows the following:

FIG. 5 in turn shows another embodiment of a winder pursuant to the invention in schematic illustration and in elevation.

DESCRIPTION OF THE PREFERRED EMBODIMENTS

Figure 1:
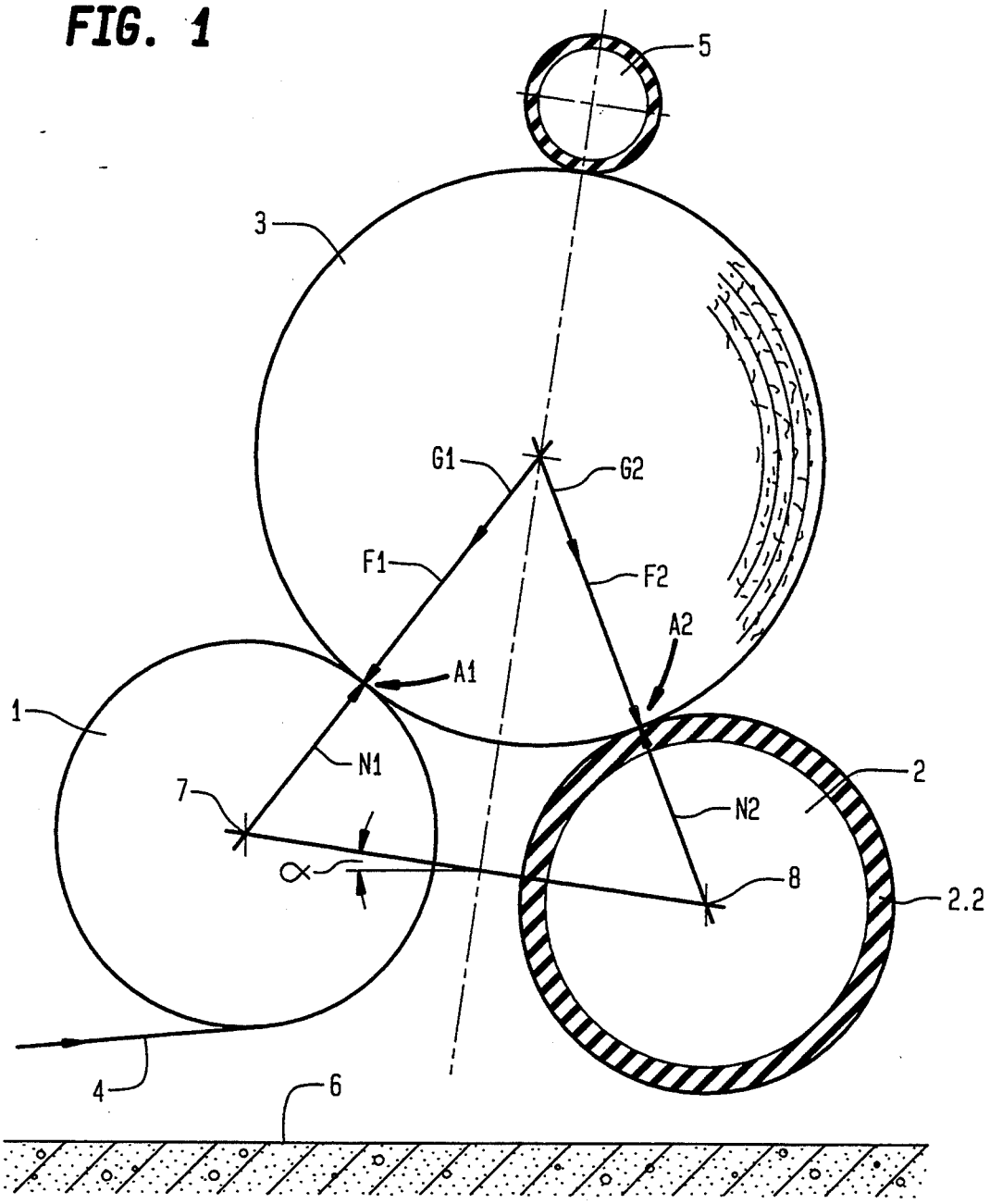
FIG. 1 shows a winder pursuant to the invention in schematic illustration and in elevation.

The winder illustrated in FIG. 1 has two support rollers 1 and 2 that together constitute a winding bed to hold a paper roll 3. The paper roll 3 is formed by rewinding a paper web 4. It can be seen that the web 4 is fed from the left bottom and first winds around the support roller 1. The paper roll 3 is loaded in a controllable manner by a load or rider roller 5 so that it also controls the surface pressure.

It can also be seen that the support roller 1 is at a higher level above the base 6 than the support roller 2. The axis 7 of support roller 1 and the axis 8 of support roller 2 are in a plane that forms an angle $\alpha$ with the horizontal. This angle $\alpha$ is an acute angle in every case. In the present case it is about 5°. In practice, far higher values can also be provided for, for example 30°. The preferred range is 0.5 to 20°.

It is also important for the support roller 2 to have a liner that is much more severely deformable than the liner of support roller 1. In the present case, the material of support roller 1 is steel while the liner 2.2 of support roller 1 is made of rubbery flexible material.

Because of the sloping arrangement, the weight G of the paper roll 3 is distributed differently to the two support rollers 1 and 2. The component G2 of the weight of the paper roll is obviously larger than the component G1. Accordingly, the support area A2 on the support roller 2 is also larger than the support area A1 on the support roller 1. In the present case, for example, A2 could be considered equal to $1.6 \times A1$.

The following conditions are desirable:

$$N1 = F1 < N2 = F2$$

$$P1 = N1/A1$$

$$P2 = N2/A/2$$

$$P1 \approx P2 \text{ (desired)}$$

The symbols mean the following:

N=Force perpendicular to the liner of the support roller

F=Force of reaction on the paper roll

P1=Surface pressure on the support roller 1

P2=Surface pressure on the support roller 2

Because of the arrangement and configuration of the winder pursuant to the invention it is possible to achieve a distinctly larger paper roll diameter than has been possible in the past. A diameter of about 1400 mm can be reached with the winder described herein, instead of up to 1200 mm previously.

Figure 2:
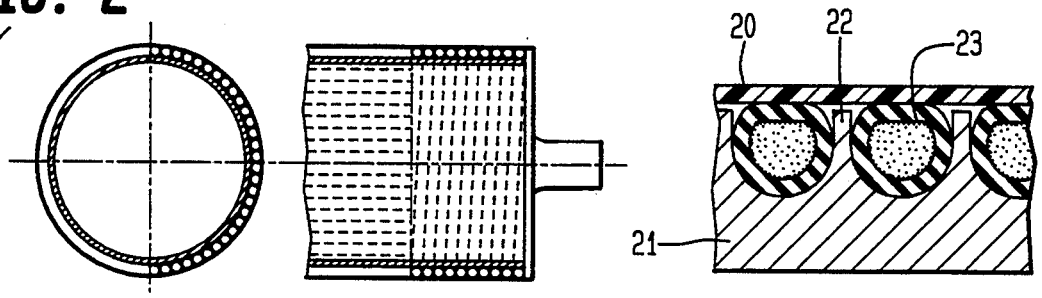
FIGS. 2 to 4 show the construction of the second (soft) support roller pursuant to the invention.
Figure 3:
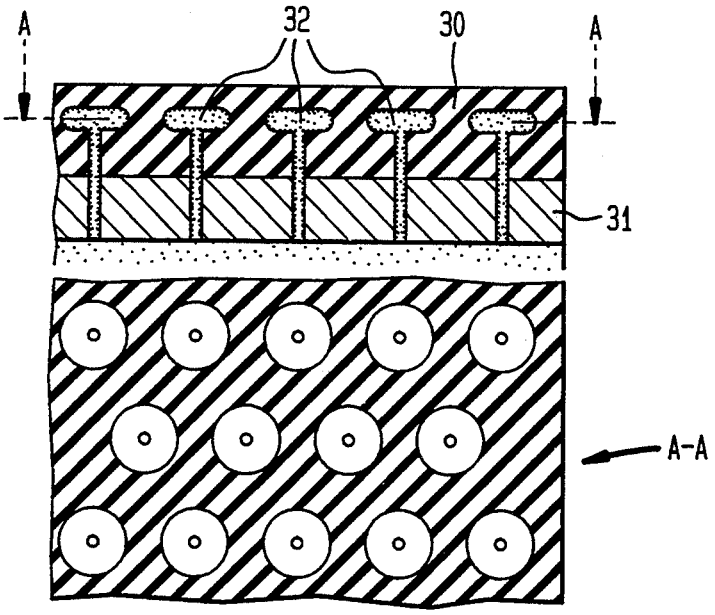
Figure 4:
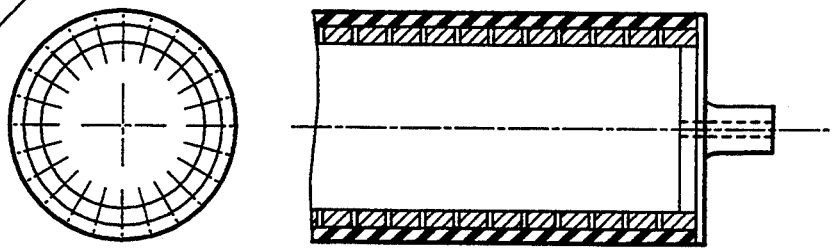
Figure 4:
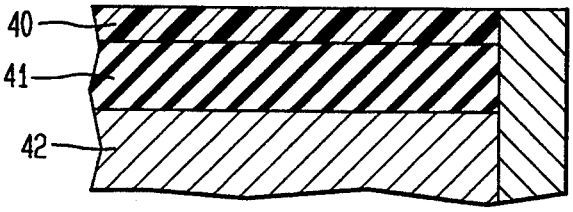

The support rollers shown in FIGS. 2 to 4 are possible variants of the liner of the support roller 2.

In the embodiment according to FIG. 2, the liner first has an outer layer 20 that has a continuous surface. This layer 20 can be steel, rubber, or another material. A helically circling coil is wound into the substance 21 of the liner so that a bridge 22, likewise circling helically, remains. A tube 23 that can be inflated is inlaid in the coil. Instead of a single tube, several tubes may naturally also be provided.

The liner according to FIG. 3 has an outer layer 30 made of rubber and an inner layer 31 made of steel. Many chambers 32 are provided in the rubber layer, which are circular viewed in cross section A—A.

The embodiment according to FIG. 4 shows a liner that is made up of three different layers, namely from outside to inside, a hard rubber layer 40, a soft rubber layer 41, and a steel body 42.

Figure 5A:
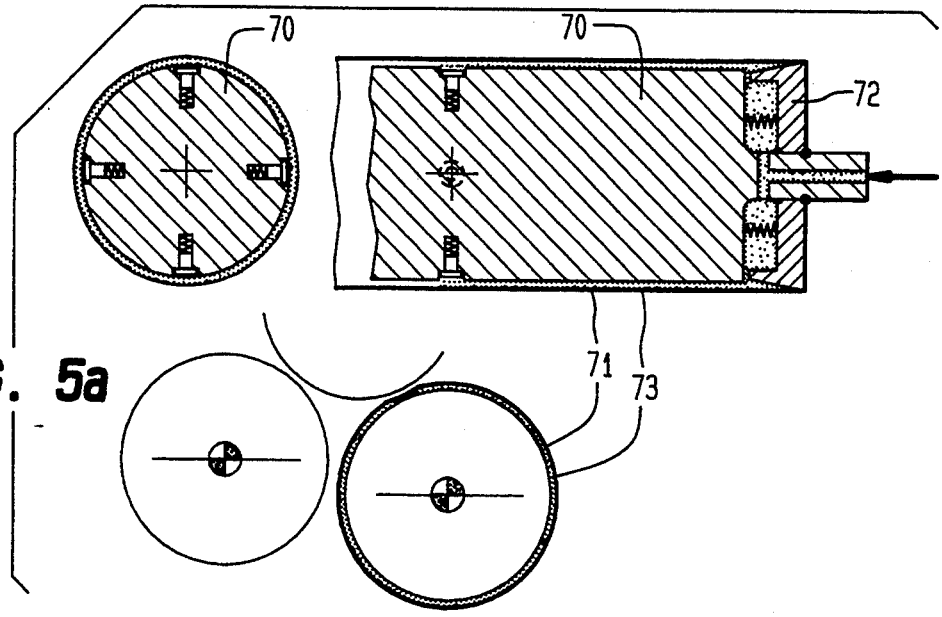
FIG. 5*a* at the top shows a support roller 2 in cross section (perpendicular to the axis) and in longitudinal section (parallel to the axis). This has an internal yoke 70 and a roller liner 71 that is clamped in caps 72 on the face (only one shown). The annular space 73 between the yoke 70 and the liner 71 can be inflated.
Figure 5B:
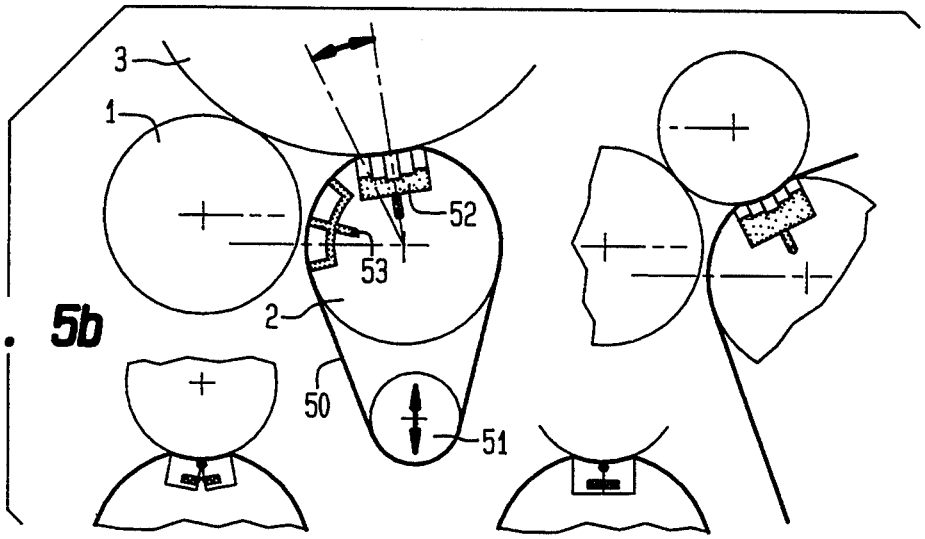
FIG. 5*b* shows another embodiment of a winder pursuant to the invention in schematic illustration and in elevation in which an encircling belt is wound around the support roller 2.

In the embodiment according to FIG. 5*b*, a stationary pressure element 2 is provided instead of a rotating support roller, and also an encircling belt 50 and a rotating guide roller 51. The belt 50 is wound around both the stationary support element 2 and the rotating guide roller 51. The stationary support element 2 has shoe elements 52 that can be pressed against the inner surface of the rotating belt 50 by pneumatic or hydraulic pressure and can thus generate a pressure. This pressure is distributed over a larger area viewed in the direction of rotation of the belt 50 and also of the paper roll 3, so that the pressure per unit area is relatively small. A lubricating mechanism 53 reduces the sliding friction between the belt 50 and the stationary support element 2.

Figure 5C:
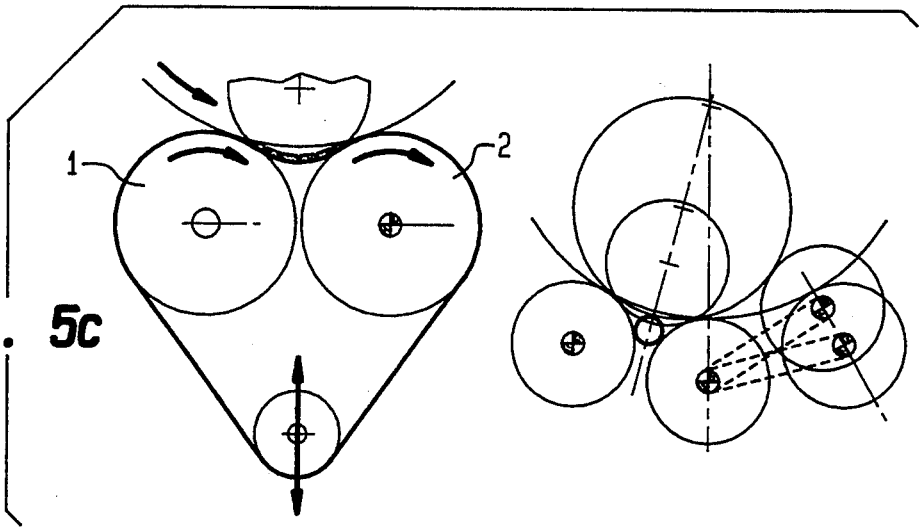
FIG. 5*c* shows a winder in elevation and in schematic illustration in which a belt is wound around both support rollers 1, 2.

FIG. 5C shows a bearing roll 1 and a bearing roll 2 with a vertically adjustable guide roller lying below. The two bearing rolls and the guide roller are looped by a rotating band. If the guide roller is moved downward, the band will be tensed and acts from underneath on the paper roll, that is found between the two bearing rolls 1 and 2, and whose diameter increases as it is wound up.

The right side of FIG. 5C shows three driven bearing rolls. The right bearing roll is also movable and, in fact, moves in response to the increase in the diameter of the paper roll.

Figure 6:
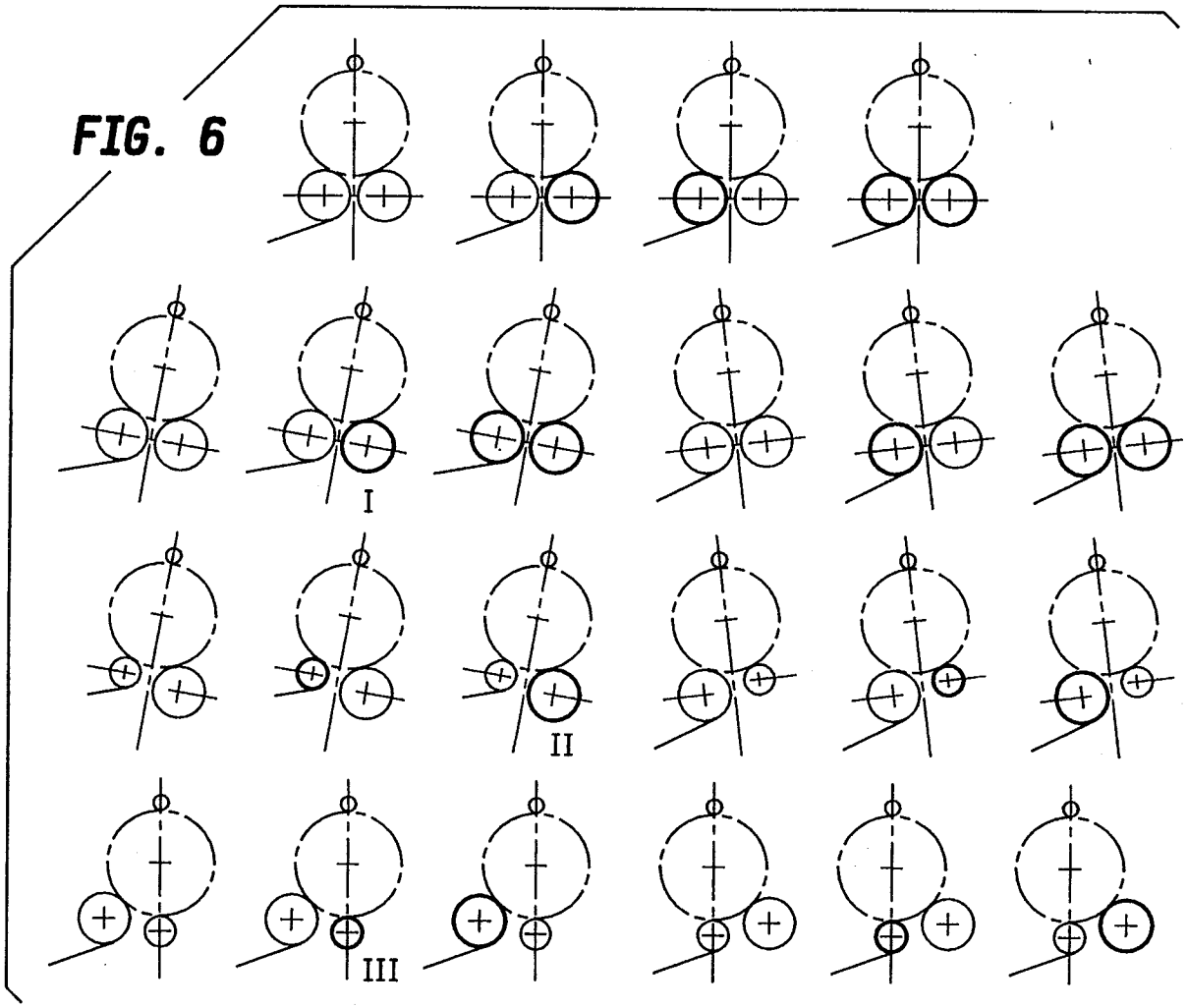
FIG. 6 illustrates 22 different roller configurations with Variants I, II and III, being pursuant to the invention.

Finally, FIG. 6 shows a number of variants, a total of 22, of which only Variants I, II, and III represent configurations pursuant to the invention.

The first support roller 1 will usually have a steel liner. However, it can also have a rubberized liner. It is important for the nature of the liner of the second support roller to be such that a "wide-nip effect" is obtained on the second support roller with regard to the first.

We claim:

1. A winder for winding a running paper web, the winder comprising a first support roller and a second support roller that together form a winding bed to hold a paper roll with the paper web wound around the first support roller, wherein the winding bed consists of the first and the second support rollers, the first and the second support rollers being fixed into position with the second support roller being positioned lower than the first support roller so that a plane through the axes of the first and the second support rollers forms an angle with a horizontal plane, the first and the second support rollers each having a liner, wherein the liner of the second support roller is considerably more deformable than the liner of the first support roller.

2. The winder pursuant to claim 1, wherein the first and the second support rollers each have a diameter, and wherein the diameter of the second support roller is about 1.05 to 2 times the diameter of the first support roller.

3. The winder pursuant to any one of claims 1 or 2, wherein the angle between the plane through the axes of the first and the second support rollers and the horizontal plane is between 1 and 20 degrees.

4. The winder pursuant to claims 1 or 2, wherein the liner of the second support roller has an outer layer that consists of rubber.

5. The winder pursuant to claims 1 or 2, wherein the liners of the support rollers have an outer layer made of elastic material.

6. The winder pursuant to claims 1 or 2, wherein the liners of the first support roller and the second support roller each has an outer layer of elastic material, and wherein the elasticity of the outer layer of the second support roller liner is greater than the elasticity of the outer layer of the first liner support roller.

7. The winder pursuant to claim 5, wherein the elasticity of the outer layer of the second support roller is greater than the elasticity of the outer layer of the first support roller.

8. The winder pursuant to claim 3, wherein the second support roller has a liner with an outer layer that consists of rubber.

9. The winder pursuant to claim 5, wherein the liner of the second support roller has an outer layer made of elastic material.

10. The winder pursuant to claim 3, wherein the liners of the first support roller and the second support roller each has an outer layer of elastic material, and wherein the elasticity of the outer layer of the second support roller liner is greater than the elasticity of the outer layer of the first support roller liner.

11. The winder pursuant to claim 4, wherein the outer layer of rubber is made of elastic material.

12. The winder pursuant to claim 5, wherein the elasticity of the outer layer of the second support roller liner is greater than the elasticity of the outer layer of the first support roller liner.

* * * * *